US006033315A

United States Patent [19]

Infantino

[11] Patent Number: 6,033,315

[45] Date of Patent: Mar. 7, 2000

[54] BOWLING PIN WITH IMPROVED POLYMERIC COATING AND METHOD OF MAKING

[76] Inventor: Joseph R. Infantino, 15 Seneca Dr., Chappaqua, N.Y. 10514

[21] Appl. No.: 09/131,027

[22] Filed: Aug. 7, 1998

[51] Int. Cl.[7] ..... A63D 9/00

[52] U.S. Cl. ..... 473/122; 473/124

[58] Field of Search ..... 473/118, 119, 473/122, 123, 124

[56] References Cited

U.S. PATENT DOCUMENTS

| | | |
|---|---|---|
| 3,142,600 | 7/1964 | Dosker . |
| 3,220,731 | 11/1965 | Germino et al. . |
| 3,404,885 | 10/1968 | Smith . |
| 3,520,969 | 7/1970 | Smith . |
| 4,445,688 | 5/1984 | Frillici et al. . |
| 4,630,820 | 12/1986 | Bertozzi . |
| 5,439,952 | 8/1995 | Lum et al. . |
| 5,532,058 | 7/1996 | Rolando et al. . |
| 5,652,299 | 7/1997 | Nakajima et al. . |

OTHER PUBLICATIONS

Dictionary of Chemical Names and Synonyms, Lewis Publishers, pp. I–374 and I–413, 1994.

*Primary Examiner*—William M. Pierce
*Attorney, Agent, or Firm*—Charles A. Wilkinson

[57] ABSTRACT

The outer two layers, composed of an undercoat of an ionomer and a topcoat of polyurethane, on a wooden core of a bowling pin are bonded together by use of either of a polyfunctional aziridine or polyfunctional carbodiimide providing superior adhesion under shock plus several shop advantages including lessened air pollution and ease of application.

20 Claims, 1 Drawing Sheet

BOWLING PIN WITH IMPROVED POLYMERIC COATING AND METHOD OF MAKING

BACKGROUND OF THE INVENTION

1. Field of the Invention

This invention relates to bowling pins and their manufacture and more particularly to wooden bowling pins having multiple layer external resinous or plastic coatings. More particularly still, the invention relates to bonding of separate layers of plastic coatings on bowling pins to each other.

2. Description of the Prior Art

It has been customary in the bowling industry to use bowling pins made of a hard shock resistant wood such as maple or preferably silver maple to resist the shocks and wear incident to being struck by bowling balls traveling at relatively high speeds and of significant weight, the usual pin weighing approximately three pounds and the usual bowling ball weighing between about 11 and 16 pounds depending upon the player. Moreover, since the contact surfaces of both the ball and the pin are convexly arcuate in configuration, the collision force between the two is exerted upon a relatively small area, or striking area, of the pin. As a result, very high shock forces are developed in the surface of the wooden pin. In addition, the relatively lighter pins, after being struck by the substantially heavier ball, attain very respectable recoil speeds, striking each other and portions of the alley pit with considerable force, further tending to damage the surface of the pin. As a result, the surface of the pin is subject to denting, chipping, pitting, and splintering as well as discoloration through abrasion and forceful imprinting into the pin surface of dirt and the like from the alley. Consequently, it has in the past been normal practice to refinish wood surfaces of bowling pins after as little as 200 to 300 games. In an attempt to alleviate these difficulties, plastic coatings and, particularly polystyrene outer plastic coatings or cladding, were in the past developed for bowling pins. This increased the life of the pin, which now could be used in favorable cases for one thousand games or more before having to be refinished or replaced. However, these polymeric clad pins also tended to be subject to the same difficulties at the surface of the pin as wooden surface pins with, however, the further problem of delamintion of the plastic coating from the surface of the underlying wooden core of the pin. Not only did the bond between the plastic coating and the hardwood core fail, but the wood itself also continued to fail as a result of crushing of the wood fibers. Once the wood fibers failed the surface coating of the pin would also not only fail itself, but become unattractive and essentially unusable.

All-resinous or solid plastic pins were also developed in the past. These were provided with a softer plastic core simulating wood and a harder plastic surface coating. Such previous pins, however, were subject to fracture of the surface coating and delamination of such coating from the core under the extreme shocks of the game exerted upon the surface of the pin and also were found to be deficient or unsatisfactory in other ways, such as, for example, making a sound upon impact unlike the sound of traditional wooden pins, which unnatural sound was frequently objected to by traditionalist bowlers. Solid plastic pins as well as some reinforced wooden pins also have not reacted or rebounded in the usual manner of wooden pins.

As a result of the foregoing difficulties, newer forms of coatings for wooden pins were developed in which an outer plastic coating was applied over a wooden core and a thinner hard abrasion and dirt resistant outer coating was adhered to the surface of the intermediate plastic coating by use of an epoxy-type intermediate bonding agent or adherent. One of the most successful of these coating systems has been the use of a so-called ionomer resin cladding such as described in U.S. Pat. No. 4,445,688 issued May 1, 1984 to Frillici and Infantino. To protect the surface of the ionomer cladding or coating from surface abrasion and soiling in such bowling pin constructions, an outer, or top, coat of a clear film of polyurethane resin has preferably been used, which outer coating has been adhered to the ionomer cladding with an epoxy or the like adhesive or bonding agent. Such top coats have been used to impart dirt and abrasion resistance to the underlying ionomer coating or cladding. Such top coats have customarily been between 0.0005 to 0.005 inches in thickness and sufficiently hard to resist dirt and soiling, but also must be sufficiently soft to be crack resistant or flexible to impact. Such outer coating should also be matched in flex resistance with the underlying ionomer resin. Furthermore, such outer coating must be well adhered to the underlying ionomer resin to prevent delamination during impact. So-called epoxy resins which typically are aromatic polyether polyepoxides, typically in turn reaction products of aliphatic glycols and epichlorohydrin, have been used to bond the outer thin polyurethane coating to the underlying ionomer coating. A wide variety of suitable curing agents such as primary and secondary aliphatic amines may be used with these epoxy bonding agents, the aim being to secure an adhesive "grip" or attachment between the underlying ionomer, and the outer polyurethane. A suitable ionomer for the primary coating is an ionic copolymer between an unsaturated alpha-olefin of from 2 to 10 carbon atoms with an unsaturated carboxylic acid having from 3 to 8 carbon atoms, plus optionally other monoethylenically unsaturated ionomers, with the copolymers having from 10% to 90% of the carboxylic acid groups in the form of a salt with metal ions, uniformly distributed throughout the copolymer. The outer polyurethane can have various compositions as long as it has a general flexibility or flex index similar to the ionomer and a hard stain-resistant surface.

Since it is important that the outer clear polyurethane film coating be securely bonded to the underlying ionomer cladding to prevent delamination and instantaneous or subsequent rupture of the film or top coat upon subjection to the rigorous shocks and stresses to which bowling pins are inherently subject, it is natural that one of the modern world's most versatile and frequently used bonding substances, i.e. epoxy resins, be used to secure the two together. However, there are difficulties. The epoxy components, i.e. the primary epoxide and the curing agent are applied as two component organic solvent based epoxy solutions. These organic base solvent solutions require large amounts of volatile organic compounds, which volatiles are very difficult to keep from escaping into the atmosphere with general environmental and working environment repercussions. It is particularly difficult to avoid contact of volatile organic compounds with the workers involved with manufacturing the plastic clad bowling pins. In addition, the ultimate bond strength is affected by the age and state of cure of the primer or epoxy bonding agent. Consequently, it is difficult to attain a uniform adhesion or bonding of the top or outer coat or film of polyurethane to the underlying ionomer cladding unless the bonding solution is rather frequently changed, which is difficult under the usual industrial plant conditions, even though having a critical degree of bonding of the two coatings is very important for preventing delamination after the pins are used in several thousand bowling games. Attempts have been made to find other effective bonding agents among the more usual bonding-type substances. However, the epoxy bonding system used for adhesion between the initial cladding with an ionomer and a thin outer film of polyurethane continues to be the standard bonding used in the industry. There has been a continuing need, therefore, for a better bonding arrangement or medium between the ionomer and the outer polyurethane coating on plastic-coated bowling pins.

The present inventor has unexpectedly discovered that two substances, namely a single component dilute water based solution of a polyfunctional aziridine or a polyfunctional carbodiimide can be substituted for the organic solvent based two component epoxy system presently being widely used. The bonding process and appurtenant processing equipment are thereby simplified and the bonding results are improved, all at a decreased cost and benefit to the environment.

OBJECTS OF THE INVENTION

It is a primary object of the present invention to provide bowling pins using an ionomer cladding plus a polyurethane top coat with an improved adhesion between these two coats.

It is a further object of the invention to provide a bowling pin having an inner layer or cladding of a first polymer coating with an outer protective film of a second polymer coating, the adjacent coating layers being bonded together by a polyfunctional aziridine.

It is a still further object of the invention to provide a bowling pin having an inner layer or cladding of a first polymer coating with an outer protective film of a second polymer coating, the adjacent coating layers being bonded together by a polyfunctional carbodiimide.

It is a still further object of the invention to provide a wooden bowling pin having a first cladding of an ionomer over which is deposited an outer protective film of a polyurethane, the two coatings being adhered or bonded together by the action of a polyfunctional aziridine.

It is a still further object of the invention to provide a wooden bowling pin having a first cladding of an ionomer over which is deposited an outer protective film of a polyurethane, the two coatings being adhered or bonded together by the action of a polyfunctional carbodiimide.

It is a still further object of the invention to provide an improved bonding of an outer protective film of polyurethane to a cladding of an ionomer by the use of either a polyfunctional aziridine or a polyfunctional carbodiimide.

It is a still further object of the invention to provide a method of producing coated wooden bowling pins by initially coating or cladding a wooden core with an initial coating or cladding of an ionomer, applying either a polyfunctional aziridine or carbodiimide to the surface of the ionomer and then applying an outer thin coating of polyurethane.

It is a still further object of the invention to provide a method of making a plastic ionomer coated wooden bowling pin to which a thin layer of securely bonded polyurethane is applied by interposing a thin coating of polyfunctional aziridine or polyfunctional carbodiimide.

It is a still further object of the invention to provide a primer for the application of an outer polyurethane layer to an inner cladding of ionomer in which volatile organic vapors are eliminated and likely measuring errors that may affect bonding are also eliminated as problems.

It is a still further object of the invention to provide a single fool-proof, water-based primer for adherence of a polyurethane outer coating to a ionomeric undercoating by providing a dilute solution of either a polyfunctional aziridine or a polyfunctional carbodiimide by which bonding may be effected.

It is a still further object of the invention to provide a more economical, easier to apply primer for use between an outer polyurethane jacket and an inner jacket of ionomer.

It is a still further object of the invention to provide a substantially more efficient primer for adhesion or bonding of polyurethane to ionomeric material comprising a dilute water-based solution of either a polyfunctional aziridine or a polyfunctional carbodiimide.

Other objects and advantages of the invention will become evident upon review of the following description and appended drawings.

SUMMARY OF THE INVENTION

In accordance with the invention, an improved plastic clad wood core bowling pin is provided by bonding together an outer protective polyurethane coating to an inner cladding of ionomer over the wood core by the use of either a polyfunctional aziridine or a polyfunctional carbodiimide in dilute preferably aqueous solution as a primer or bonding agent between the ionomeric cladding and an outer polyurethane protective coat. The general method of making the improved bowling pin of the invention is to initially form the wooden core of the bowling pin, then to form an ionomer casing for the wooden pin in any suitable method known in the art and established on the surface of the wooden core in any suitable manner. The surface of the ionomer casing is next preferably roughened by abrasion and treated with either a polyfunctional aziridine or polyfunctional carbodiimide after which an outer film of polyurethane is applied over the polyfunctional aziridine or carbodiimide to form a hard, abrasion resistant outer layer flexibly bonded to the ionomer.

The aziridine or carbodiimide solution essentially eliminates volatile organic vapors, substantially reduces formulating errors because it is a single component system, increases adherence of the two plastic coatings and is substantially cheaper.

DESCRIPTION OF THE PREFERRED EMBODIMENTS

Figure 1:
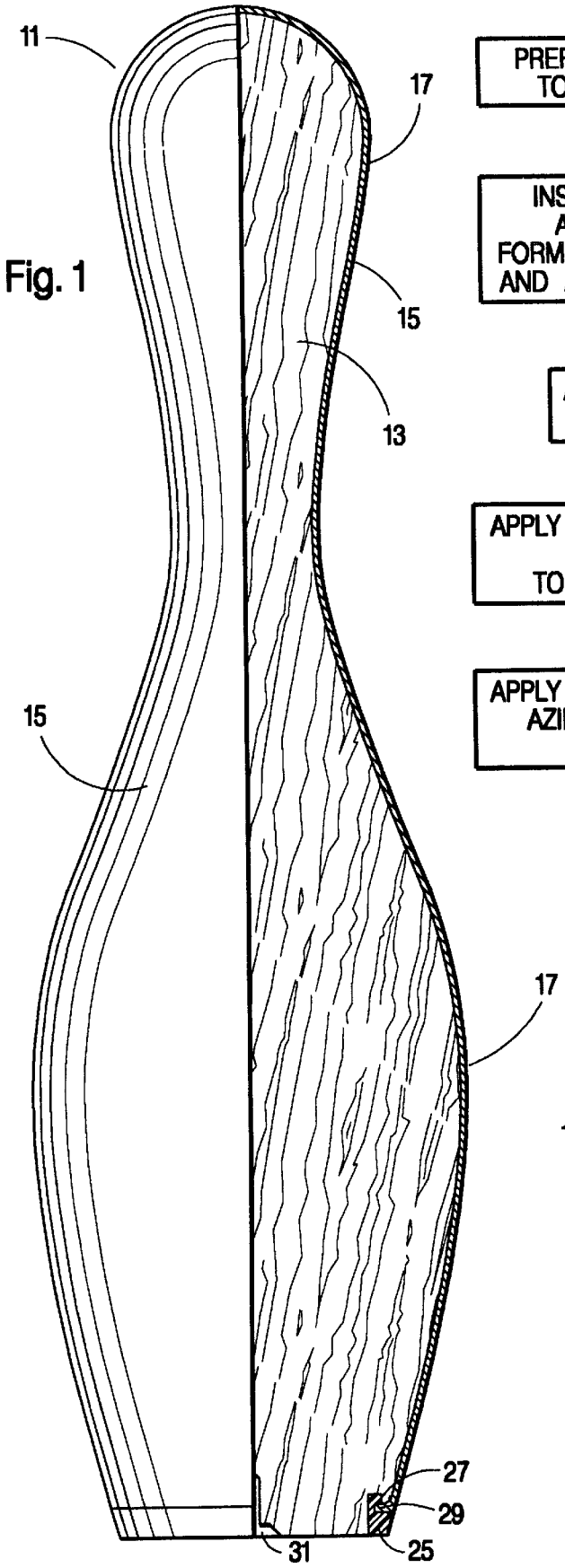
FIG. 1 is a drawing partially in cross-section of a plastic coated wooden bowling pin in accordance with the invention.

As disclosed in U.S. Pat. No. 4,445,688 issued May 1984 to F. Frillici and the present inventor a very superior outer plastic coating for wooden bowling pins is provided by the provision of an ionomer casing applied directly over the wooden pin plus a thin outer film of clear polyurethane which protects the underlying ionomer casing or coating. It is necessary to securely bond the polyurethane layer to the ionomer layer or casing to prevent fracture of such outer layer or delamination from the underlying ionomer layer and bonding has been accomplished more or less uniformly in the past by one or more of the ubiquitous industrial epoxy-type bonding agents essentially formulated for this purpose. The disclosure of the U.S. Pat. No. 4,445,688, including the disclosures of other earlier patents noted therein, are specifically incorporated into the present application together with the disclosure of U.S. Pat. No. 3,264,272 which describes ionomers and particularly the E.I. Dupont de Nemours and Company class of ionomers known as Surlyn®. Epoxy-type bonding agents have several disadvantages, including the fact that they are normally applied as two-part systems of organic liquid carrier agents which (a) inherently give off noxious organic liquid vapors, wherein (b) the two-part mixing operation inherently tends to lead to mixing errors with resultant poor bonding results, wherein (c) the component ingredients tend to age or cure prematurely, i.e. to polymerize before being applied to the bonding environment, again leading to variability in bonding and frequently providing unsatisfactory bonding and last, but not least, (d) the epoxy-bonding agents and their application are relatively costly. The necessity to take special precautions to avoid organic vapor induced air pollution is one of the most serious of the disadvantages of the use of epoxy-bonding agents, followed by the continuing difficulty presented by miscalculation or careless physical formulating of the two component system in an industrial setting.

The present inventor has unexpectedly discovered that the normal epoxy-bonding agents used in bonding of the outer protective film of polyurethane to the underlying casing of ionomer in the plastic coating or encasement of a wooden bowling pin, can be substituted for by either of two unique bonding agents, particularly adapted to this particular use with very significant advantages and better overall bonding. These two unique bonding agents, which are, in fact, not customarily thought of as bonding or adhering agents, are polyfunctional aziridine and polyfunctional carbodiimide, which, it has been discovered, in this particular environment, not only provide better bonding of the polyurethane to the underlying ionomers, but also have other advantages, namely the aziridine and carbodiimide systems are single rather than multiple component systems that do not have to have to be mixed in the shop, are essentially non-aging, since they do not react until in contact with the surfaces to be adhered and, in addition, do not give off noxious organic vapors, considerably alleviating air pollution considerations in the working environment. While known as useful cross linking agents in regulating the polymerization of organic resins both within more or less uniform resin systems and even between dissimilar resins in a single resin system, there is no prior disclosure or suggestion known to the present inventor that these compounds could be used as bonding agents or primers between separate discrete layers of plastics, and particularly between a base layer or cladding of ionomer and a top layer or outer protective coating of polyurethane in the production of plastic coated bowling pins. In fact, considering the extreme shock and deflection stresses to which bowling pins are subjected, it is completely surprising that these at best mild polymerization inducing agents would provide even reasonably satisfactory bonding much less superior bonding in the adhesion together of the outer coatings of bowling pins. The present invention has proved to be supremely useful in the environment in which it is used for this particular purpose and a significant and surprising step forward in the industry.

In FIG. 1, there is shown in half section a bowling pin 11 having a conventional hardwood core 13, usually formed of maple or silver maple and a plastic or polymeric outer coating 15 shown in a surface view on the left and in cross section on the right. While polymeric coating 15 is shown of uniform thickness over the surface of the pin core, the plastic coating may, as is fairly conventional, be thicker at the convex striking points or areas 17 in the waist and upper neck of the pin which tend to receive the majority of impact from traveling bowling balls and other pins as well as any underlying surface upon which the pin may fall or topple over. The majority of the thickness of the polymeric coating is comprised of a suitable ionomer as disclosed in U.S. Pat. No. 4,445,688 plus a very thin protective film of clear polyurethane which is too thin to be depicted in cross section in FIG. 1, but is shown in enlarged section in FIG. 2 as a thin protective layer 19 which is formed of polyurethane on or covering the surface of the ionomer 21 or, more generally, the surface of the bowling pin 11. Between the outer protective polyurethane 19 and the ionomer layer 21 is a so-called bonding layer 23 in which the polyfunctional aziridine or polyfunctional carbodiimide have entered into reaction with the base material of both the ionomer and the polyurethane bonding the two together. Both the aziridine and the carbodiimide as the name implies have available amine moieties or reaction sites, and it is believed these enter into direct chemical combinations with acid groups on the ionomers plus other active groups on the polyurethane. A molecular monolayer of aziridine or carbodiimide would be ideal, but as a practical matter a layer several molecules thick of the aziridine or carbodiimides is probably actually bonding the two coatings together.

In effect, therefore, there is a very thin essentially microscopic region between the two plastic layers in which the bonding agent has entered into reaction with the adjacent coating components and bonded them to each other. This inter-bonded layer is designated by reference numeral 23.

At the bottom of the bowling pin core is conventionally mounted, a Nylon® ring 25 which in effect reinforces the bottom of the pin to prevent wear which might result in an unstable base. There are several possible embodiments of such Nylon® rings, the preferred ring being that shown in U.S. Pat. No. 4,322,078, issued Mar. 30, 1982 to R. Mallette, in which the ring has a side groove 27 into which the lower end 29 of the casing of ionomer is molded to hold the ring in place, after which the surface of the casing of ionomer is abraded, the bonding agents of the invention applied and the top or outer protective coating of polyurethane applied. A pin setting orifice 31 conventionally is provided in the center of the bottom of the pin. The particular Nylon® ring construction and arrangement and the pin setting orifice do not form any part of the present invention.

Figure 3:
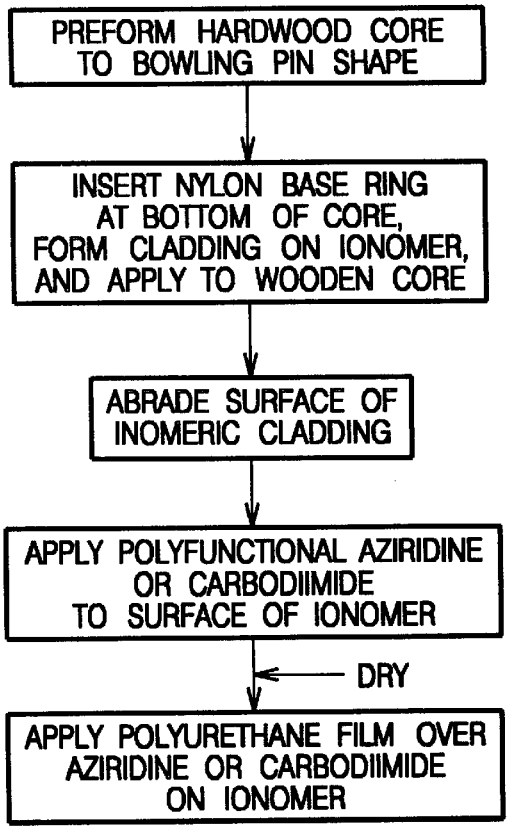
FIG. 3 illustrates diagrammatically the method or sequence of coating in accordance with the present invention.
Figure 2:
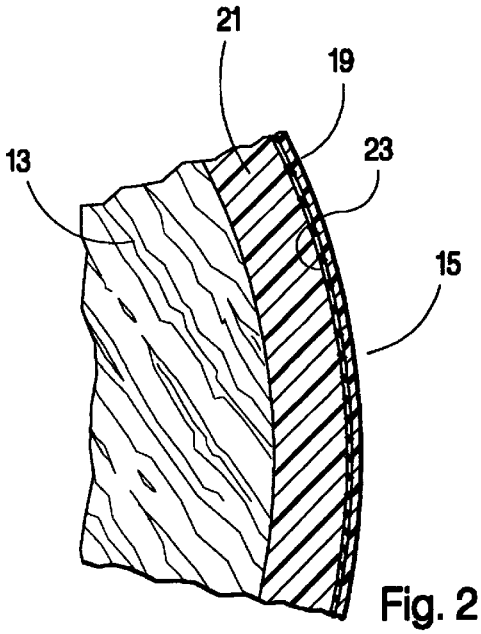
FIG. 2 is an enlarged detail of the bowling pin coating in accordance with the invention.

FIG. 3 is a diagrammatic figure indicating the steps involved in making the bowling pin 11 shown in FIGS. 1 and 2 in which a hardwood core is first preformed to the shape of a bowling pin and a Nylon® reinforcing ring applied to the bottom. A cladding of ionomer is then formed, usually in a mold or the like, and applied to the surface of the pin core (usually the cladding will be made in a mold to precise dimensions and then secured to the surface of the wooden core in a hot molding step), but the cladding can also be formed directly upon the wooden base or core within a mold or by any other suitable means which will form a precisely uniform cladding. Injection molding directly over the wooden core with core centering is a practical method of forming the ionomer coating or cladding, if proper core centering is effected in the mold. Unequal coatings on different sides of the pin have the disadvantage of changing the weight distribution and balance of the pin. After the cladding is applied to the surface of the pin, or if it is a separately produced or molded cladding, possibly before, the outer surface of the ionomer cladding is roughened usually by abrading to increase later bonding. Alternatively, some other equivalent means may be used to activate the bonding surface. Thereafter, a water-based polyfunctional aziridine or carbodiimide is applied to the surface by spraying, flowing, dipping or the like and, thereafter, a thin film of clear polyurethane is applied over the surface of the aziridine or carbodiimide again by spraying, flowing or dipping and then dried. Upon testing, it is found that the outer film tenaciously adheres to the ionomer, yet is flexible and well cushioned.

In essence, the present invention contemplates a bowling pin comprised of a wooden core member and an ionomer cladding surrounding the core member. The ionomer cladding may be of various types and blends of ionomers. The surface of the ionomer cladding is first preferably abraded to a matte finish or otherwise treated to accomplish a similar effective surface finish. The cladding is then coated with a dilute solution of either a polyfunctional aziridine or a polyfunctional carbodiimide. From a cost, worker-hygiene and environment-protection point of view, water is the preferred solvent. However, appropriate organic solvents may also be employed to dilute the primers or bonding agents. The primers or bonding agents of the invention are applied to the abraded ionomer surface by either spraying, flowing or dipping. The surface is then dried to remove substantially all water. Next a topcoat is applied by either spraying, flowing or dipping. Such a top coating is usually a polyurethane applied at a dry-film thickness ranging generally from 0.0005 to 0.005 in. The topcoat may be of various types including solvent-based moisture-curing polyurethane, two-component solvent-based polyurethane, two-component, water-based polyurethane or single-component, water-based polyurethane. The topcoat is then dried or cured, usually at elevated temperatures generally in the range of 110 to 150° F. In the case of moisture-curing polyurethane, it is usually cured at temperatures ranging from 100 to 130° F. and a relative humidity ranging from 50% to 80%. The dried or cured polyurethane topcoat bonds tenaciously to the primer surface with sufficient bond strength to survive thousands of bowling games without delaminating from the ionomer surface. Ionomer-clad bowling pins without any primers at all manifest close to 100% delamination of the polyurethane topcoat after less than 100 games of bowling. Ionomer-clad bowling pins with the presently used epoxy primers usually manifest peeling of the polyurethane topcoat at the edges of cuts or scratches.

While numerous ionomers and blends of ionomers can be employed in this invention with good results, the preferred ionomer comprises a copolymer of ethylene and methacrylic acid, particularly the sodium type having a melt flow between 0.5 and 5.0 gms/10 minutes (ASTM D-1238, Condition E) and a flex modulus between about 40,000 and 60,000 psi (ASTM D-790A). Such a material is available from DuPont as Surlyn® 8920 or Surlyn® 8940. Excellent results have been obtained using Surlyn® 8920. Similar good results are obtained using a copolymer of ethylene and ethacrylic acid, particularly the sodium type and having physical properties similar to those listed above. Such ionomer is available from Exxon Chemical as Iotek 8000.

It has also been found that the primers of this invention provide a good topcoat bond when used on claddings comprised of blends of ionomers where the sodium type of ionomer comprises at least 40% of the cladding by weight.

The ionomer cladding may be injection molded as a hollow structure shaped to conform to the exterior wall of a half section of a bowling pin and provide a minimum wall thickness of 0.070 to 0.080 in. Such half sections are then applied in a mold to the wood core using heat and pressure. The cladding may also be applied to the wood core by injection molding using the wood core as a centered mold insert.

Preferably a Nylon® insert will be applied to the bottom of the wood pin in a conforming circumferential groove about the bottom of the pin prior to the application of the Surlyn® cladding and the bottom end of the Surlyn® cladding locked into a groove in the side of the Nylon® insert to prevent withdrawal of such Nylon® insert.

To assist in providing good adhesion of the subsequent coating, the ionomer cladding is preferably initially abraded on the outer surface to remove any evidence of shininess and thus provides a surface with a flat, matte-like appearance. Any other suitable method to provide such a matte-like surface may be used. However, abrading is at present by and large the best and most effective way to prepare the surface for bonding of the outer coat.

In the first preferred embodiment of the present invention, the primer or bonding agent for the ionomer cladding comprises a dilute solution of a polyfunctional aziridine. The presently preferred polyfunctional aziridine is XR-2500 from Stahl, USA Inc. of Peabody, Mass., having a CAS (Chemical Abstracts Service) number 151-56-4. The preferred solvent for the aziridine is water. Good topcoat adhesion has been achieved at concentrations ranging from 0.1% to 25%. The preferred concentration range for consistency and economy is 0.5% to 10%. As will be recognized, this broad range indicates that minor formulation errors, which are unlikely in any event in this single component system, also are unlikely to detrimentally affect the final bond.

It has been found that other polyfunctional aziridines also provide good bonds with polyurethane topcoats. These are CX-100 from Zeneca Resins of Wilmington, Mass., and XAMA-7 and XAMA-2 from EIT Inc. of Lake Wylie, S.C. However, XAMA-2 has limited solubility in water.

In the second preferred embodiment of the present invention, the primer comprises a dilute solution of a polyfunctional carbodiimide. The preferred polyfunctional carbodiimide is XR-5558 obtained from Stahl, USA Inc. The material is listed as proprietary and details of its chemical structure are not available. It is sold as a 50% solution in 1-methoxy-2-propanol acetate having a density of 8.67 pounds/gallon and a boiling range (solvent only) of 302–303° F.

Other polyfunctional carbodiimides, also proprietary, provide good bonds with polyurethane topcoats. These are XR-2569 from Stahl, USA Inc. and Ucarlink Crosslinker XL-29SE from Union Carbide of Danbury, Conn.

The polyfunctional carbodiimides have been found to be effective in promoting polyurethane topcoat adhesion at concentrations ranging from 0.2% to 30%, but preferably 0.5% to 15%. Again this fairly broad range indicates the practicality of use of this bonding agent in an industrial setting.

The preferred topcoat is a clear aliphatic, solvent-based, moisture-curing polyurethane available from Stahl, USA Inc. as SU-26202. It is available as a 42% solution in xylene. It has an NCO content of 8.25%±0.75%, a viscosity of 200–350 centipoises and a density of 8.2 pounds/gallon. As indicated above, a variety of other polyurethanes are usable so long as its surface is hard in the sense of being both abrasion and dirt resistant with a flex index approximately equivalent to and preferably the same as that of the underlying ionomer.

The following examples are of test results obtained using various combinations of coatings and bonding materials including no bonding agent at all. It can seen particularly in Table 1, where the test results are provided in terms of bond strength in PSI as measured by a tensile test, but also in Table 2 where the measure is visually observed delamination or separation of layers in a standard tumbling test in a rotating drum, that the bonding obtained by the primer or bonding agents of the invention are uniformly and significantly better than a comparable prior art epoxy-type bonding agent or primer and, of course, dramatically better than the use of no bonding agent at all, which as a practical matter is completely unacceptable.

EXAMPLE 1

Molded 3-inch by 1-inch strips of various ionomers and ionomer blends were abraded to a matte surface. Strips of each type were dipped in various primer solutions and air dried thirty minutes. Several strips of each type, used as controls, were not coated with the primers. The strips were dipped into a 35% solids solution by weight of Stahl, USA's moisture-curing polyurethane SU-26101. After air drying for ten minutes, two strips of each type were clamped together one inch from their ends so that the polyurethane coating became the adhesive layer between them. All samples were cured at ambient conditions for two weeks. Testing of the bond strength was accomplished on an Instron universal tester whereby the ends of the samples were clamped in vertically opposing jaws. A tensile force was applied by the vertical movement of the jaws at 2 inches per minute. The force was recorded in pounds per square inch (psi).

The various primers used in the test samples listed in Table 1 are:

A. 2% KR-2500: polyfunctional aziridine, in water

B. 6% KR-5558: polyfunctional carbodiimide, in water

C. 3% two-component epoxy primer* in butyl acetate and xylene

D. No Treatment

*Stahl, USA's XR-1794 and XR-1802 at 1 to 1 by volume.

TABLE 1

| Ionomer | Primer | Bond Strength psi |
|---|---|---|
| Surlyn 8920 | A | 222 |
| Surlyn 8920 | B | 213 |
| Surlyn 8920 | C | 187 |
| Surlyn 8920 | D | 20 |
| Iotek 8000 | A | 243 |
| Iotek 8000 | B | 230 |
| Iotek 8000 | C | 201 |
| Iotek 8000 | D | 59 |

TABLE 1-continued

| Ionomer | Primer | Bond Strength psi |
|---|---|---|
| Surlyn 8940 | A | 204 |
| Surlyn 8940 | B | 200 |
| Surlyn 8940 | C | 161 |
| Surlyn 8940 | D | 50 |
| Iotek 8000/7010, a 70/30 Blend of Sodium and Zinc Types | A | 236 |
| Iotek 8000/7010, a 70/30 Blend of Sodium and Zinc Types | B | 220 |
| Iotek 8000/7010, a 70/30 Blend of Sodium and Zinc Types | C | 196 |
| Iotek 8000/7010, a 70/30 Blend of Sodium and Zinc Types | D | 47 |
| A 60/40 Blend of Zinc and Sodium-Type Surlyn provided by DuPont | A | 195 |
| A 60/40 Blend of Zinc and Sodium-Type Surlyn provided by DuPont | B | 186 |
| A 60/40 Blend of Zinc and Sodium-Type Surlyn provided by DuPont | C | 173 |
| A 60/40 Blend of Zinc and Sodium-Type Surlyn provided by DuPont | D | 42 |

EXAMPLE 2

Surlyn-clad bowling pins were surface abraded and dipped in KR-2500 (polyfunctional aziridine) and KR-5558 (polyfunctional carbodiimide) at various concentrations in water. Several pins were dipped in Stahl, USA's two-component epoxy primer at 3% solids in butyl acetate and xylene. Several pins were not treated or primed. The primed pins were dried at 110° F. for ten minutes, then topcoated with a moisture-cured polyurethane, Stahl, USA's SU-26202. The coating was cured over night at 110 °F. and 75% r.h. plus four days at ambient conditions. The coating on each pin was razor-scribed with an "X." The pins were placed in a test unit consisting of a rotating steel drum and tumbled for three hours. The pins were then examined for topcoat loss. Results are shown in Table 2.

TABLE 2

| IONOMER | PRIMER | TUMBLE TEST RESULTS |
|---|---|---|
| Surlyn 8920 | 00.1% KR-2500 in water | Slight coating loss at scribe edge. |
| Surlyn 8920 | 00.5% KR-2500 in water | No coating loss. |
| Surlyn 8920 | 02.0% KR-2500 in water | NO coating loss. |
| Surlyn 8920 | 10.0% KR-2500 in water | No coating loss. |
| Surlyn 8920 | 25.0% KR-2500 in water | NO coating loss. |
| Surlyn 8920 | 03.5% Stahl Epoxy Primer | Slight coating loss at scribe edge. |
| 60/40 Zinc/Sodium-Type Surlyn Blend | 00.1% KR-2500 in water | Slight coating loss at scribe edge. |
| 60/40 Zinc/Sodium-Type Surlyn Blend | 00.5% KR-2500 in water | No coating loss. |
| 60/40 Zinc/Sodium-Type Surlyn Blend | 02.0% KR-2500 in water | No coating loss. |
| 60/40 Zinc/Sodium-Type Surlyn Blend | 10.0% KR-2500 in water | No coating loss. |
| 60/40 Zinc/Sodium-Type Surlyn Blend | 25.0% KR-2500 in water | No coating loss. |
| 60/40 Zinc/Sodium-Type Surlyn Blend | 03.5% Stahl Epoxy Primer | Slight coating loss at scribe edge. |
| Surlyn 8940 | 00.2% KR-5558 in water | Slight coating loss at scribe edge. |
| Surlyn 8940 | 03.0% KR-5558 in water | No coating loss. |
| Surlyn 8940 | 06.0% KR-5558 in water | No coating loss. |
| Surlyn 8940 | 10.0% KR-5558 in water | No coating loss. |
| Surlyn 8940 | 30.0% KR-5558 in water | No coating loss. |
| Surlyn 8940 | No Treatment | 70%–80% Coating loss on entire pin surface. |
| 60/40 Zinc/Sodium-Type Surlyn Blend | 00.2% KR-5558 in water | Slight coating loss at scribe edge. |
| 60/40 Zinc/Sodium-Type Surlyn Blend | 03.0% KR-5558 in water | No coating loss. |
| 60/40 Zinc/Sodium-Type Surlyn Blend | 06.0% KR-5558 in water | No coating loss. |
| 60/40 Zinc/Sodium-Type Surlyn Blend | 10.0% KR-5558 in water | No coating loss. |
| 60/40 Zinc/Sodium-Type Surlyn Blend | 30.0% KR-5558 in water | No coating loss. |
| 60/40 Zinc/Sodium-Type Surlyn Blend | No Treatment | 70%–80% Coating loss on entire pin surface. |

EXAMPLE 3

Forty pins clad with Surlyn 8920 were abraded, dipped in a 2% solution of KR-2500, coated with SU-26202 and cured as in Example 2. Forty pins clad with Surlyn 8920 and abraded were dipped in a 6% solution of KR-5558 and coated in similar fashion as those dipped in KR-2500. These were experimentally placed in bowling alleys along with "standard" pins, i.e., clad with Surlyn 8920 and coated with SU-26202 but having a prime coat on the cladding of 3% two-component epoxy primer. Pins were held in play for approximately one year during which time they were periodically examined. The pins treated with KR-2500 and KR-5558 showed no loss of topcoat. The "standard" pins each had several areas of ⅛-inch or ¼-inch diameter coating loss at the head areas.

EXAMPLE 4

Example 3 was repeated with 1,000 pins each with the KR-2500 and KR-5558 treatments. The pins exhibited no topcoat loss after one year's use.

The present invention has been found to be very effective in bonding an outer thin polyurethane overcoat to an underlying ionomer coating or casing on the core of a multiple layer bowling pin and particularly a wooden core of such a bowling pin. The new intermediate bonding agents or materials, i.e. polyfunctional aziridine and carbodiimide, not only provide very effective and superior bonding in a difficult, hard to bond environment, but provide in addition very important subsidiary benefits related to avoiding air pollution with noxious organic vapors and allowing easier formulation. The bonding of the two plastic coating layers is difficult because of the adverse environment continuously subject to major very suddenly applied shock or impact forces, which have a well recognized tendency to separate layered structures along any type of discontinuity between such layers by small increments of delamination which can quickly grow under continued impact forces into major delaminations and complete separation. The well recognized principle of such separation is for a severe shock or blow to differentially stretch adjacent bonded surfaces, whereupon there is a distinct propensity for one surface to pull loose along a short arcuate distance from the other. Once slightly separated the two surfaces under continuing subsequent impacts tend to further separate tearing loose along the edges as one surface is wedged by continuing impact forces away from the other. This can quickly lead to substantial separations between the layers and even complete delamination. The most effective remedy to such separation is to create such a tenacious bond at closely spaced flexible bonding points as to effectively prevent an initial separation in any substantial area under shock forces of the usual magnitude encountered in the particular environment. It is believed that creation of such tenacious closely spaced bonding points occurs in the application of polyfunctional aziridine or carbodiimide to bonding together of a thin polyurethane coating and an underlying ionomer coating on bowling pins, although the exact mechanism is not known. In addition to the superior bonding, the bonding materials of the invention as indicated above alleviate the problem of air pollution with noxious vapors from the volatile organic compounds normally used as application and mixing mediums for other bonding agents such as the usual epoxy bonding agents. In addition these new bonding agents are not subject to shop measuring and mixing errors, since such agents are single component-type agents.

While the present invention has been described at some length and with some particularity with respect to several described embodiments, it is not intended that it should be limited to any such particulars or embodiments or any particular embodiment, but is to be construed broadly with reference to the appended claims so as to provide the broadest possible interpretation of such claims in view of the applicable prior art and therefore to effectively encompass the intended scope of the invention.

I claim:

1. A method of plastic coating a bowling pin comprising:

(a) providing a wooden bowling pin core, (b) coating the wooden core with an ionomeric plastic underlayer, (c) coating the surface of the ionomeric underlayer with a dilute solution of a bonding agent taken from the group of reactive chemical compounds consisting of polyfunctional aziridine and polyfunctional carbodiimide, and (d) applying an overcoating of polyurethane.

2. A method of plastic coating a bowling pin in accordance with claim 1 in which the polyfunctional aziridine or carbodiimide are applied in a substantially aqueous based solution to the ionomeric underlayer.

3. A method of plastic coating a bowling pin in accordance with claim 2 wherein the polyurethane is applied in the form of a moisture-curing composition.

4. A method of plastic coating a bowling pin in accordance with claim 3 wherein the surface of the ionomeric plastic underlayer is abraded to a matte-type surface prior to applying the bonding agent.

5. A method of plastic coating a bowling pin in accordance with claim 4 wherein the wooden bowling pin core is coated with a sodium-type copolymer of ethylene and methacrylic acid.

6. A method of plastic coating a wooden bowling pin core in accordance with claim 4 wherein the pin core is coated with a blend of sodium and zinc types of a copolymer of ethylene and methacrylic acid in which the blend is more than 50% of the zinc type.

7. A method of plastic coating a bowling pin in accordance with claim 2 wherein the bonding agent is polyfunctional aziridine in a solution percentage of between 0.1% and 25.0% of the aqueous solution.

8. A method of plastic coating a bowling pin in accordance with claim 2 wherein the bonding agent is polyfunctional carbodiimide in a solution percentage of between 0.5% and 30.0% of the aqueous solution.

9. A method of plastic coating a bowling pin in accordance with claim 2 wherein the polyurethane topcoat is applied from an aqueous solution.

10. A method of plastic coating a bowling pin in accordance with claim 2 wherein curing of the polyurethane topcoat proceeds by the reaction of two different solutions.

11. A method of plastic coating a bowling pin in accordance with claim 1 wherein the aziridine or carbodiimide is dissolved in an organic solvent.

12. A wooden bowling pin having a multi-layer, outer-plastic coating comprising:

(a) a plastic casing of an ionomer, (b) a thin bonding layer of polyfunctional aziridine, (c) a plastic outer coating of polyurethane.

13. A wooden bowling pin in accordance with claim 12 wherein the plastic ionomer casing is a sodium-type copolymer of ethylene and methacrylic acid.

14. A wooden bowling pin in accordance with claim 12 wherein the plastic ionomer is a blend of sodium and zinc types of a copolymer of ethylene and ethacrylic acid including more than 50% of the sodium-type.

15. A wooden bowling pin in accordance with claim 12 wherein the polyurethane topcoat is formed from a polyurethane of a moisture-curing nature.

16. A wooden bowling pin in accordance with claim 12 wherein the polyurethane topcoat is formed from the reaction of two diverse components.

17. A wooden bowling pin having a multi-layer, outer-plastic coating comprising:

(a) a plastic casing of an ionomer, (b) a thin bonding layer of polyfunctional carbodiimide, (c) a plastic outer coating of polyurethane.

18. A wooden bowling pin in accordance with claim 17 wherein the plastic ionomer casing is a sodium-type copolymer of ethylene and methacrylic acid.

19. A wooden bowling pin in accordance with claim 17 wherein the plastic ionomer is a blend of sodium and zinc types of a copolymer of ethylene and ethacrylic acid including more than 50% of the sodium-type.

20. A wooden bowling pin in accordance with claim 17 wherein the polyurethane topcoat is formed from a polyurethane of a moisture-curing nature.

* * * * *